United States Patent [19]

Watanabe

[11] Patent Number: 4,722,518

[45] Date of Patent: Feb. 2, 1988

[54] SHEET FEEDER

[75] Inventor: Junji Watanabe, Yokohama, Japan

[73] Assignee: Kabushiki Kaisha Toshiba, Kawasaki, Japan

[21] Appl. No.: 792,845

[22] Filed: Oct. 30, 1985

[30] Foreign Application Priority Data

Oct. 31, 1984 [JP] Japan ..... 59-227901

[51] Int. Cl.[4] ..... B65H 5/26

[52] U.S. Cl. ..... 271/9; 271/10; 271/114; 271/242

[58] Field of Search ..... 271/9, 10, 114, 242, 271/226, 256, 264, 266, 272; 192/62 R, 84 R

[56] References Cited

U.S. PATENT DOCUMENTS

| | | | |
|---|---|---|---|
| 3,327,823 | 6/1967 | Miller | 192/67 R |
| 4,025,187 | 5/1977 | Taylor et al. | 271/10 |
| 4,354,759 | 10/1982 | Bujese | 271/10 |
| 4,519,601 | 5/1985 | Watanabe | 271/114 |
| 4,548,394 | 10/1985 | Koyama et al. | 271/10 |
| 4,645,192 | 2/1987 | Watanabe | 271/242 X |

FOREIGN PATENT DOCUMENTS

| | | | |
|---|---|---|---|
| 0155133 | 12/1981 | Japan | 271/242 |
| 0108635 | 6/1984 | Japan | 271/10 |

*Primary Examiner*—Joseph J. Rolla
*Assistant Examiner*—David H. Bollinger
*Attorney, Agent, or Firm*—Finnegan, Henderson, Farabow, Garrett & Dunner

[57] ABSTRACT

A sheet feeder for feeding sheets one by one to a transfer path comprises feed rollers, aligning rollers, a reversible motor and a one-way clutch arranged between the motor and the aligning roller and, when the motor is rotated in one direction, transmitting a motive power to the aligning roller. Clutch mechanisms for transmitting the rotation of the motor is arranged between the motor and the feed rollers. Each of the clutch mechanisms includes a pair of connectors formed with mating indentations, the connectors being adapted for engagement with or disengagement from each other when the motor is stopped.

10 Claims, 7 Drawing Figures

FIG. 4
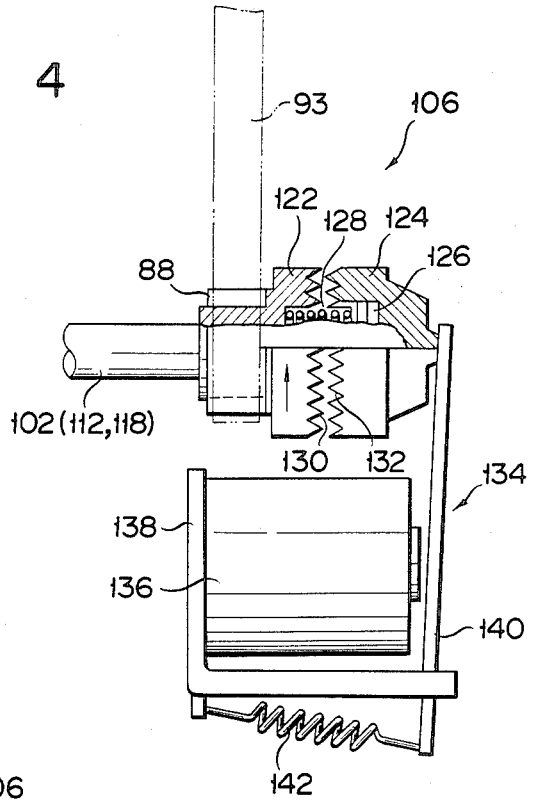
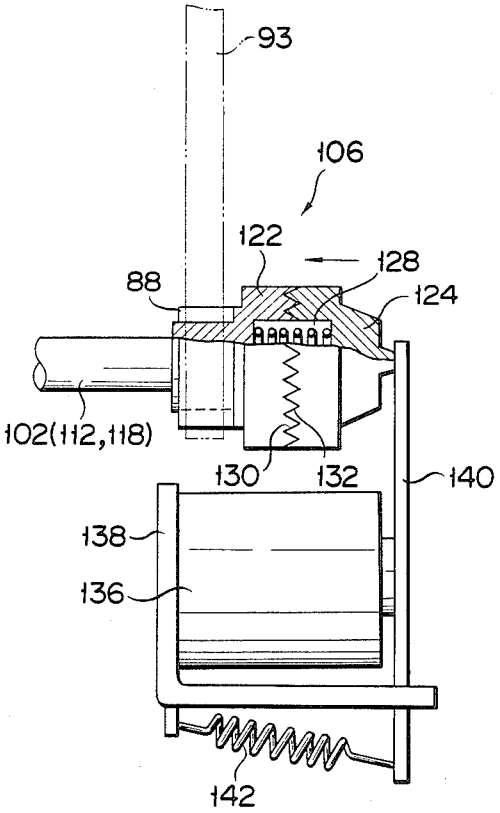
FIG. 5

SHEET FEEDER

BACKGROUND OF THE INVENTION

The present invention relates to a sheet feeder for feeding paper sheets, and, more specifically to a sheet feeder for feeding copying paper to the developing unit of a copying machine.

In a sheet feeder of this type, a plurality of paper sheets previously stored in a sheet cassette are fed one by one to a photosensitive body, as a developing unit, during a copying operation, so that a copied image is formed on each paper sheet. Such a sheet feeder comprises a paper-supply roller for taking the paper sheets out of the sheet cassette, and a pair of aligning rollers for lining up the sheets before they are delivered to the developing unit. After being taken out of the sheet cassette by the paper-supply roller, each paper sheet is temporarily stopped by the aligning rollers to have its leading edge lined up. After the leading edge of the paper sheet is lined up, the aligning rollers are driven so that the sheet is delivered to the developing unit.

In the conventional sheet feeder constructed in this manner, the paper-supply roller and the aligning rollers are driven independently, and are alternatively started or stopped. According to this sheet feeder, however, the paper-supply roller and the aligning rollers are driven by a single, common motor. Thus, the sheet feeder unit is provided with a drive mechanism actuated by a single motor; and the paper-supply roller and the aligning rollers are fitted individually with clutches which can be coupled to the drive mechanism. As the clutches are alternatively coupled to the drive mechanism, the driving force is transmitted to either the paper-supply roller or the aligning rollers. Conventionally, electromagnetic clutches or spring clutches (one-way clutches) have been used for this purpose. Electromagnetic clutches, however, are expensive and may sometimes be subject to slippage when in a connected state, attributable to the wear of the clutch plates. With spring clutches, on the other hand, a spring is normally in sliding contact with the driving-side shaft of the clutch such that it is liable to wear or fatigue, resulting in a diminishment of its resiliency. In some cases, therefore, the spring clutches may fail to transmit the driving force when connected.

Thus, the driving force of the motor cannot be securely transmitted to the paper-supply roller and the aligning rollers, failing to feed the paper sheets securely from the sheet feeder. This would necessitate the use of more expensive clutches, resulting in increased cost of the sheet feeder.

SUMMARY OF THE INVENTION

The object of the present invention is to provide a sheet feeder which assures a positive paper feed in a simpler arrangement of low cost.

According to the present invention, there is provided a sheet feeder for feeding sheets one by one along a transfer path, comprising:

feed roller means for delivering and feeding the sheets to the transfer path;

aligning roller means disposed in the transfer path and adpated to align each sheet fed along the transfer path;

a drive source for driving the feed roller means and the aligning roller means;

one-way means arranged between the drive source and the aligning roll means and adapted to transmit a motive power to the aligning roller means when the drive source is driven in one direction; and clutch means arranged between the drive source and the feed roller means, and adapted to intermittently transmit the driving force of the drive source to the feed roller means, the clutch means including a pair of connectors formed individually with sets of mating indentations, the pair of connectors being adapted for engagement with or disengagement from each other when the drive source is switched off.

BRIEF DESCRIPTION OF THE DRAWINGS

FIGS. 4 and 5 are partial sectional views illustrating the operation of a clutch used in the sheet feeder of FIG. 2;

DETAILED DESCRIPTION OF THE PREFERRED EMBODIMENT

An embodiment of the present invention will now be described in detail with reference to the accompanying drawings of FIGS. 1 to 6.

Figure 1:
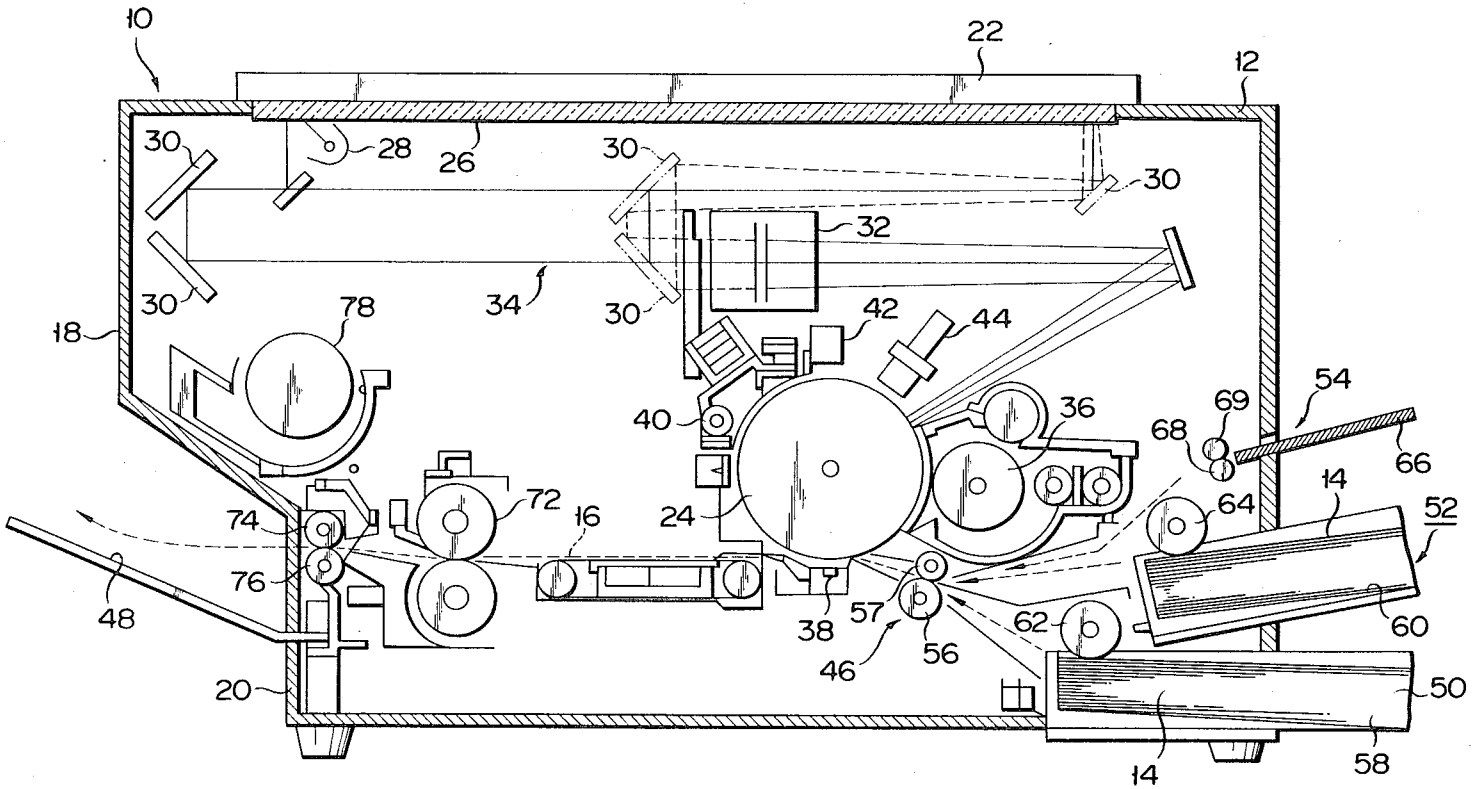
FIG. 1 is a schematic sectional view of a copying machine using a sheet feeder according to an embodiment of the present invention.

FIG. 1 shows an electronic copying machine 10 according to the embodiment of the invention. The electronic copying machine 10 has a housing or body 12 which consists of an upper unit (first housing) 18 and a lower unit (second housing) 20. The upper and lower units 18 and 20 are divided by a transfer path (indicated by broken line) 16 through which copying paper 14 is fed. Generally liable to jam, the conveyor path 16 may be exposed when the two units 18 and 20 are separated from each other. The body 12 carries thereon a turnable cover 22 which holds the original paper (not shown) designated for copying. A photosensitive body 24 is rotatably supported in the substantially central portion of the interior of the body 12 so that an electrostatic latent image is formed on the surface of the photosensitive body 24 by a light beam applied thereto. Between the photosensitive body 24 and the cover 22 lies an exposure mechanism 34 which comprises a table 26 on which is placed the original, a lamp 28 for irradiating the table 26, mirrors 30 for reflecting a light beam from the original 26 onto the photosensitive body 24, and a lens unit 32 for reducing or magnifying images. Adjacent to the photosensitive body 24 is a developing device 36 for developing an electrostatic latent image formed on the photosensitive body 24 by applying a toner to the image, and a transfer device 38 for transferring a toner image on the surface of the photosensitive body 24 to the copying paper 14. Also adjacent to the photosensitive body 24 is a cleaning device 40 for removing the toner on the photosensitive body 24, a deelectrifier 42 for removing the electrostatic latent image on the photosensitive body 24, and a charger 44.

The starting end of the transfer path 16 is coupled to a sheet feeder (sheet feeding unit) 46 which is located at one side of the lower unit 20 to feed the copying paper 14 to the transfer path 16, while the extreme end of the transfer path 16 extends to an outlet tray 48 which receives discharged copies.

The sheet feeder 46 comprises a first cassette loading section 50, a second cassette loading section 52, a manual inserting section 54, and a pair of aligning rollers 56 and 57 for lining up copying paper sheets fed from any one of these sections. The first cassette loading section 50 is fitted with a first cassette 58 which stores copying paper sheets of one size, and the second cassette loading section 52 is fitted with a second cassette 60 which stores copying paper sheets of another size. The paper sheets are delivered alternatively from the cassette 58 or 60. The first cassette loading section 50 includes a first paper-supply roller 62 for feeding the paper sheets toward the aligning rollers 56 and 57. Likewise, the second cassette loading section 52 includes a second paper supply roller 64. The manual inserting section 54 for inserting a sheet by hand is provided with a guide tray 66 and a pair of feed rollers 68 and 69 for feeding the paper sheet inserted along the guide tray 66 toward the aligning rollers 56. The first and second paper-supply rollers 62 and 64, the feed rollers 68 and 69, and the aligning rollers 56 and 57 are coupled to a drive mechanism 70 which will be described later with reference to FIG. 2 and 3.

A fixing device 72 for fixing the toner to the paper sheet and exit rollers 74 and 76 are arranged near the extreme end of the transfer path 16. A cooling fan unit 78 is disposed over the exit rollers 74 and 76.

Figure 2:
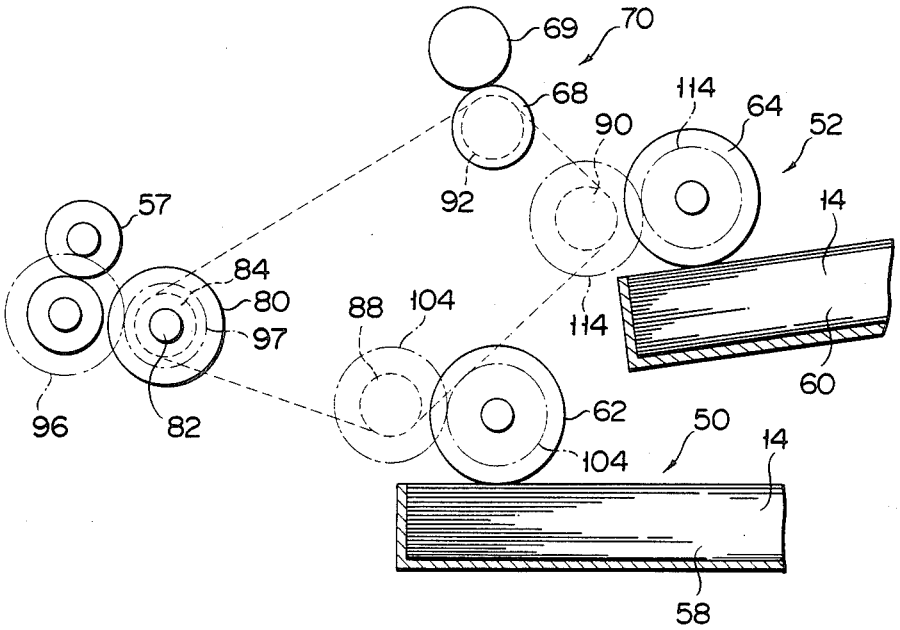
FIG. 2 shows an outline of the sheet feeder used in the copying machine of FIG. 1.
Figure 7:
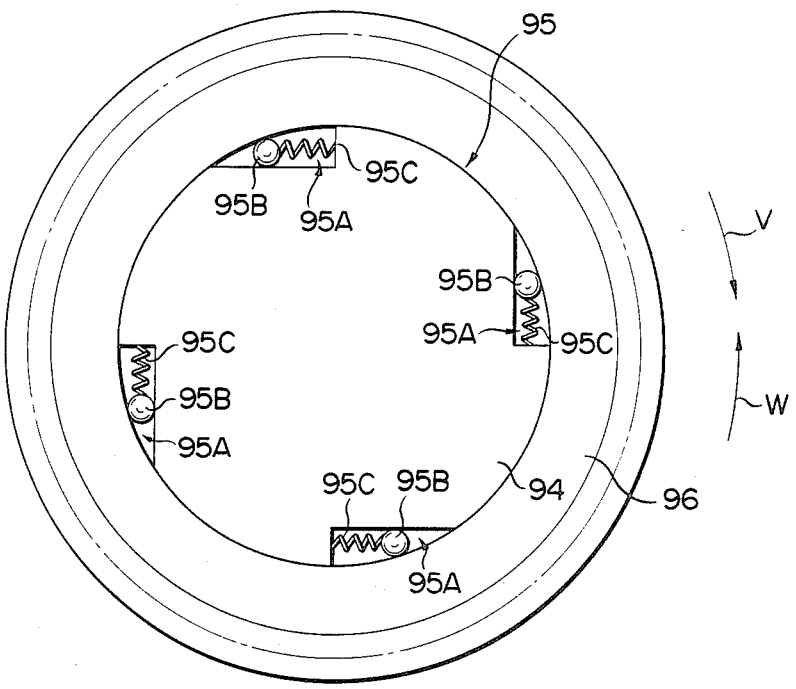
FIG. 7 shows a cross-sectional view showing a one-way clutch in FIG. 3.
Figure 3:
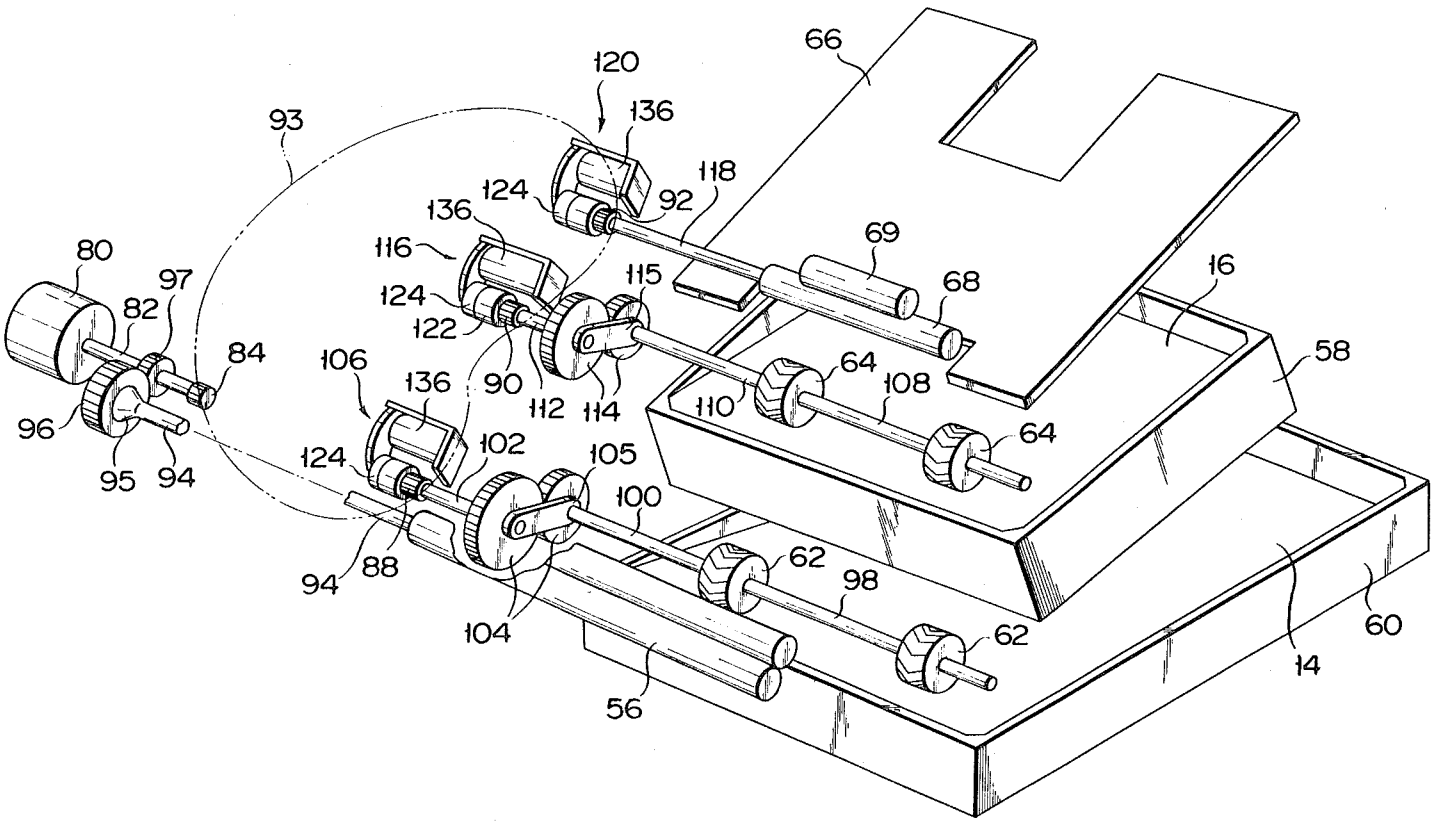
FIG. 3 is a perspective view schematically showing the construction of the sheet feeder of FIG. 2.

Referring now to FIGS. 2 and 3, the drive mechanism 70 for the sheet feeder 46 will be described in detail. The drive mechanism 70 includes a pulse motor 80 as a drive source, whose drive shaft 82 (shown in FIG. 3) is fitted with a driving pulley (first pulley) 84. The drive mechanism 70 further includes, second, third, and fourth pulleys 88, 90 and 92. A timing belt 93 is passed around the individual pulleys to transmit the driving force of the pulse motor 80. A gear 96 is attached at one end to a shaft 94 of the aligning roller 56 through a one-way clutch 95. On the portion of the drive shaft 82 situated between the motor 80 and a pulley 84 is provided a gear 97 which is in mesh with a gear 96. In the one-way clutch 95, four wedge-like grooves 95A are equidistantly formed in the shaft 94, as shown in FIG. 7, which slides on the inner surface of the gear 96. The respective wedge-like groove 95A becomes narrower from its base end portion toward its forward end portion. Within the respective wedge-like groove are disposed a ball 95B and a spring 95C for urging the ball 95B toward the forward end portion, that is, a narrower end portion of the wedge-like groove. In the arrangement of the one-way clutch 95, when the gear 96 is rotated in a direction indicated by an arrow V in FIG. 7, the ball 95B in the wedge-like groove 95A is moved toward the base end portion of the groove to permit the gear 96 to be slid along the surface of the shaft 94. As a result, no rotational force is transmitted to the shaft 94. When, on the other hand, the gear 96 is rotated in a direction indicated by an arrow W in FIG. 7, the ball 95B in the groove is moved, under the urging force of a spring 95C, toward the forward end portion of the groove. In this case, a frictional contact force acts upon a spot between the ball 95B and the gear 96 and upon a spot between the ball 95B and the shaft 94, causing the shaft to be rotated in a direction indicated by an arrow W in FIG. 7. As evident from the above, the one-way clutch 95 can transmit a rotational force to the shaft 94 only when the gear is rotated in the direction of arrow W. The second pulley 88 is mounted on a portion of one end of a shaft 98 of the first paper-supply roller 62. The shaft 98 of the first paper-supply roller 62 is divided into two parts, a first shaft 100 mounted with the roller 62 and a second shaft 102 coupled to the first shaft 100 so as to rotate around the same.

The first and second shafts 100 and 102 are connected by means of a pair of gears 104 which mesh with each other. The two shafts 100 and 102 are also coupled by means of a link 105 so that the first shaft 100 can rotate around the second shaft 102. The second shaft 102 is fitted with a first clutch mechanism 106, whereby the driving force of the second pulley 88 is transmitted to or cut off from the first paper-supply roller 62. The third pulley 90 is mounted on a portion of one end of a shaft 108 of the second paper-supply roller 64, the shaft 108 of the second paper-supply roller 64 is divided into first and second shafts 110 and 112 which are coupled to each other by means of a pair of gears 114 and a link 115.

The second shaft 112 is fitted with a second clutch mechanism 116, whereby the driving force of the third pulley 90 is transmitted to or cut off from the second paper-supply roller 64. The fourth pulley 92 is mounted on a portion of one end of a shaft 118 of the feed roller 68 for manual feed. The shaft 118 of the feed roller 68 is fitted with a third clutch mechanism 120, whereby the driving force of the fourth pulley 92 is transmitted to or cut off from the feed roller 68.

Referring now to FIGS. 4 and 5, the clutch mechanisms will be described in detail. Since the first to third clutch mechanisms 106, 116 and 120 are of the same construction, only the first clutch mechanism 106 will be described for the sake of brevity.

As shown in FIG. 4, the first clutch mechanism 106 is provided with first and second connectors 122 and 124 which can engage each other. The first connector 122, which is formed integral with the first pulley 84, is rotatably mounted on the shaft 102. On the other hand, the second connector 124 is coupled to the shaft 102 by means of a pin 126 so as to be slidable along the axial direction of the shaft 102 and fixed in the rotating direction of the shaft 102. A coil spring 128 is interposed between the first and second connectors 122 and 124. The coil spring 128 normally urges the first and second connectors 122 and 124 away from each other. The first and second connectors 122 and 124 are formed with sets of teeth 130 and 132, on their respective facing sides.

The first and second connectors 122 and 124 are adjoined by an electromagnetic unit 134 which is adapted to connect the two connectors 122 and 124 so that it might oppose the urging force of the spring 128. The electromagnetic unit 134 includes an electromagnet 136 wound with a coil, and an L-shaped support frame 138 for supporting the electromagnet 136. A portion of the proximal end of an armature 140 is rockably attached to the support frame 138, while a portion of its distal end abuts against the second connector 124. The electromagnet 136 is arranged opposite the intermediate portion of the armature 140; and a spring 142 is fixed to a portion of the proximal end of the armature 140. Thus, the spring 142 urges the intermediate portion of the armature 140 away from the electromagnet 136.

When the electromagnet 136 is excited in the above-mentioned arrangement of the clutch mechanism, the armature 140 rocks against the urging force of the spring 142 so that the distal end portion of the armature 140 presses on the second connector 124, as shown in FIG. 5. Then, the second connector 124 slides along the axis of the shaft 102 against the urging force of the spring 128, thereby engaging the first connector 122. As a result, the rotation of the first pulley 84 is transmitted to the shaft 98 of the first paper supply roller 62. Having their teeth 130 and 132 engaged, in this case, the first and second connectors 122 and 124 are securely connected without the possibility of slippage.

The operation of the copying machine 10 using the sheet feeder 46 according to the present invention will now be described in detail.

In forming an image, the original paper on the table 26 is scanned by the exposure mechanism 34, and a light beam reflected from the original is applied to the photosensitive body 24 through the mirrors 30 and the lens unit 32. By this illumination, an electrostatic latent image responsive to the original image is formed on the surface of the photosensitive body 24 which is charged by the main charger 44. This electrostatic latent image is delivered to the developing device 36 where it is supplied, with developing agent, to be developed into a visible image. Thereafter, the image is transmitted to the transfer device 38.

Meanwhile, the paper sheet 14 from the sheet feeding unit has been supplied to the transfer device 38. Namely, the pulse motor 80 is started to drive the timing belt 93 so that the second to fourth pulleys, 88, 90 and 92 begin rotation. In this case, the shaft 82 of the motor 80 is rotated clockwise, that is, in the normal direction and no power is transmitted to the shaft 94 through the one-way clutch 95. When each of the clutch mechanisms is connected, the pulse motor 80 is caused to pause in this case. The timing for the start and stop of the pulse motor 80 and the connection and disconnection of the clutch mechanisms will be described in detail later.

If a desired clutch mechanism, e.g. the first clutch mechanism 106, is to be connected when the pulse motor 80 is stopped, the electromagnet 136 of the first clutch mechanism 106 is energized. Then, the excitation of the electromagnet 136 causes the armature 140 to be rocked against the urging force of the spring 142 by means of magnetic attraction. Thus, the armature 140 pushes the second connector 124 against the urging force of the spring 128. Accordingly, as shown in FIG. 5, the second connector 124 engages with the first connector 122, thereby connecting the clutch mechanism 106. As the clutch mechanism 106 is connected, the rotational force of the first connector 122 is transmitted through the second connector 124 to the shaft 102 so that the aligning roller 56 is rotated. The second and third clutch mechanism 116 or 120 are similarly connected.

Paper is taken out through any one of the paper supply rollers 62, 64 and 68 and supplied in a predetermined amount toward the aligning rollers 56, 67. In this case, however, the aligning rollers are stopped. Thus, the leading edge of the paper sheet abuts against the aligning rollers 56, 57 for alignment. After the pulse motor 80 has been temporarily stopped, it is rotated counterclockwise, i.e., in the reverse direction. In this case, the rotation of the gear 96 is transmitted to the shaft 94 through the one-way clutch 95. In consequence, the aligning rollers 56, 57 are rotated, permitting the paper sheet to be supplied to a location between the photosensitive body 24 and the transfer device 38.

Figure 6:
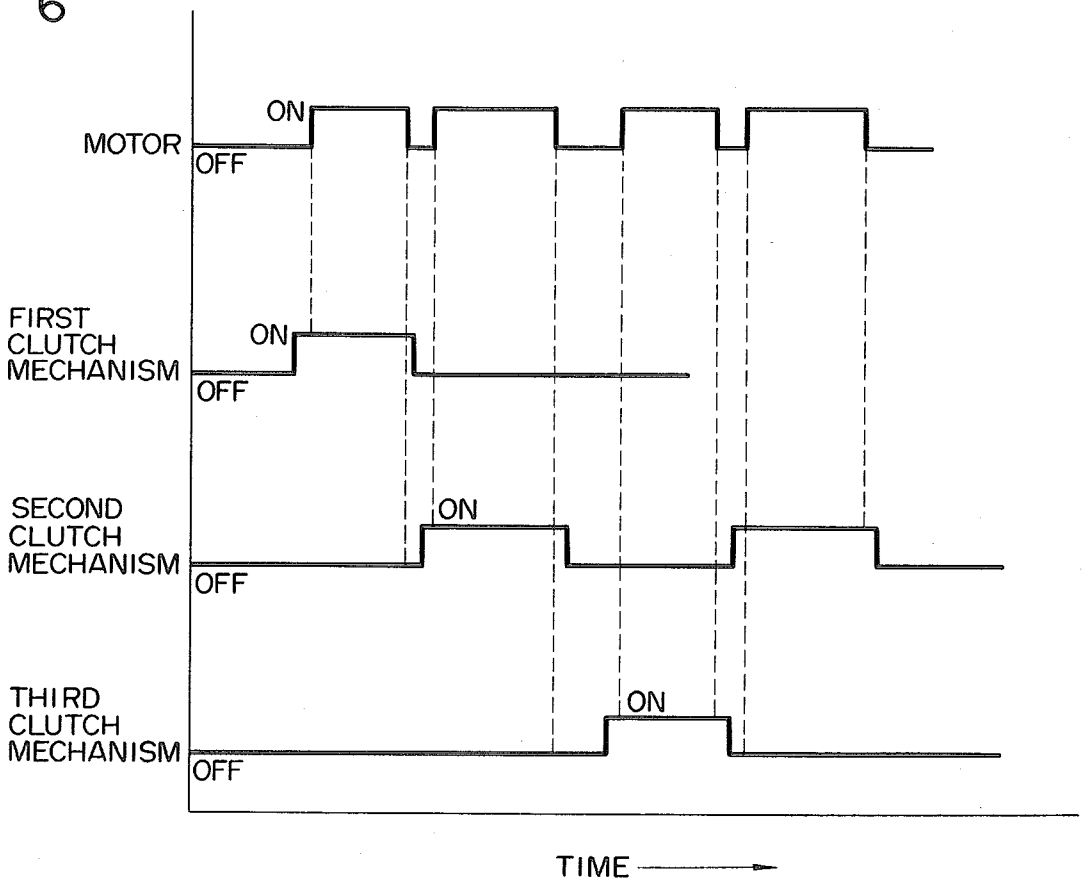
FIG. 6 is a timing chart of the sheet feeder of FIG. 2.

Referring now to FIG. 6, the timing for the operation of the motor 80 and the connection and disconnection of the clutch mechanisms will be described. In the timing chart of FIG. 6, the abscissa represents time, while the ordinate represents the timing for the operation of the motor 80 and the connection and disconnection of the first, second and third clutch mechanisms 106, 116 and 120 of the first and second paper-supply rollers 62 and 64, and the aligning roller 56. As seen from FIG. 6, the first and second connectors 122 and 124 of each clutch mechanism are connected when their teeth 130 and 132 engage, so that the motor 80 needs to be stopped at the time of connection or disconnection of the clutch mechanism. Thus, any of the clutch mechanisms are connected or disconnected only when the motor 80 is off. At the time of sheet feeding, the first clutch mechanism 96 (aligning roller 56) is connected a predetermined time after any of the first, second and third clutch mechanisms 106, 116 and 120 is connected.

Thus, whether manually fed or automatically fed from the sheet cassette 58 or 60, the paper sheet 14, is delivered to the aligning rollers 56 and 57 to be lined up thereby, and then passed between the photosensitive body 24 and the transfer charger 38 so that an image on the photosensitive body 24 can be transferred to the sheet 14. Thereafter, the paper sheet 14 is delivered to the fixing device 72 where the image is fixed, and the paper sheet 14 is ejected into the outlet tray 48 by the exit rollers 74 and 76.

According to the sheet feeder 46 of this embodiment, the clutch mechanisms for controlling the drive of the first and second paper-supply rollers 62 and 64, and the feed roller 68, are connected through the engagement of their teeth, thus ensuring secure transmission of the driving force without a slip.

According to this invention the aligning roller 56 is coupled to the shaft 82 of the motor 80 through the one-way clutch, and separated from the loop of the timing belt 93 for rotating the paper supply rollers 62, 64, 68. In consequence, the aligning roller 56 does not involve any backlash which may occur due to the use of the timing belt 93. Thus, the aligning roller 56 can be driven with high accuracy. Since, in particular, the shaft of the aligning roller 56 is coupled to the gear on the motor shaft, the accuracy of the aligning of the paper sheet and the timing when the paper sheet feeding is effected can be improved in a simpler arrangement.

According to the embodiment of the invention, the shaft 94 of the aligning roller is substantially independent of the shaft of the motor through the one-way clutch and, since the aligning roller is separated from the timing belt for driving the feed rollers, it is possible to alleviate a load on the motor when the aligning roller only is driven. It is, therefore, possible to lower the operation cost.

It is to be understood that the present invention is not limited to the embodiment described above, and that various changes and modifications may be effected by one skilled in the art without departing from the scope or spirit of the invention.

In the above embodiment, for example, the first and second paper-supply rollers and the manual feed rollers are used as feed rollers. Alternatively, however, only the first paper-supply roller may be used. In this case, paper sheets are fed from only one sheet cassette. Although being allowed to rotate in only one direction, the motor may be rotated in either direction as required. In case of jamming, for example, the aligning roller 56 can be reversed to clear the excess paper sheets.

In each clutch mechanism, according to the above embodiment, the first and second connectors are each formed with a plurality of teeth on their facing sides. Alternatively, however, the two connectors may be formed individually with mating indentations, e.g., a combination of a projected cross and a recessed cross which can engage each other.

Furthermore, the present invention is not limited to the use as a sheet feeder in a copying machine, and may also be used as a bank note counter, a printing apparatus, etc.

As the one-way clutch use may be made of other types of clutches, such as a spring clutch.

What is claimed is:

1. A sheet feeder for feeding sheets one by one along a transfer path, comprising:

feed means for delivering the sheets to the transfer path, said feed means including a rotatable feed roller;

aligning means, located in the transfer path, for aligning each sheet fed along the transfer path, said aligning means including a pair of rotatable aligning rollers with a nip portion therebetween;

a drive source having a rotatable output shaft, said drive source selectively driving said output shaft to rotate in a forward or reverse direction when said drive soure is switched on;

one-way means, connected between said output shaft of said drive source and one of said aligning rollers, for transmitting rotation of said output shaft to said one aligning roller when said output shaft is rotated in said reverse direction, said one-way means preventing transmission of rotation to said one aligning roller when said output shaft is rotated in said forward direction; and transmitting means for selectively transmitting rotation of said output shaft of said drive source to said feed roller.

2. A sheet feeder according to claim 1, wherein:

said output shaft of said drive source includes a first gear fixed thereto;

said one aligning roller includes a shaft portion fixed thereto; and said one-way means includes a second gear engaged with said first gear and a one-way clutch positioned between said second gear and said shaft portion of said one aligning roller.

3. A sheet feeder according to claim 1, wherein said transmitting means includes:

a drive pulley fixed to said output shaft of said drive source;

a driven pulley rotatably connected to said feed roller;

a time belt connecting said drive pulley and said driven pulley; and clutch means connnected between said driven pulley and said feed roller for selectively transmitting rotation of said driven pulley to said feed roller.

4. A sheet feeder according to claim 3, wherein said clutch means includes:

first and second connectors having complementary mating indentations, said first connector being fixed to said driven pulley and said second connector being connected to said feed roller and axially slidable to engage or disengage said first connector;

means for normally biasing said second connector away from said first connector to disengage said connectors; and means for selectively engaging said connectors to transmit rotation of said output shaft of said drive source to said at least one feed roller.

5. A sheet feeder according to claim 4, wherein said engaging means includes:

a support frame;

an electromagnet fixed to said support frame;

an armature pivotally mounted on said support frame and having a first end contacting said second connector; and means for biasing said armature out of contact with said electromagnet;

wherein excitation of said electromagnet pivots said armature into contact with said electromagnet and moves said second connector into engagement with said first connector.

6. A sheet feeder for feeding sheets one by one along a transfer path, comprising:

feed means for delivering the sheets to the transfer path, said feed means including a plurality of rotatable feed rollers;

aligning means, located in the transfer path, for aligning each sheet fed along the transfer path, said aligning means including a pair of rotatable aligning rollers with a nip portion therebetween;

a drive source having a rotatable output shaft, said drive source selectively driving said output shaft to rotate in a forward or reverse direction when said drive source is switched on;

one-way means, connected between said output shaft of said drive source and one of said aligning rollers, for transmitting rotation of said output shaft to said one aligning roller when said output shaft is rotated in said reverse direction, said one-way means preventing transmission of rotation to said one aligning roller when said output shaft is rotated in said forward direction; and transmitting means for selectively transmitting rotation of said output shaft of said drive source to one or more of said feed rollers.

7. A sheet feeder according to claim 6, wherein:

said output shaft of said drive source includes a first gear fixed thereto;

said one aligning roller includes a shaft portion fixed thereto; and said one-way means includes a second gear engaged with said first gear and a one-way clutch positioned between said second gear and said shaft portion of said one aligning roller.

8. A sheet feeder according to claim 6, wherein said transmitting means includes:

a drive pulley fixed to said output shaft of said drive source;

a plurality of driven pulleys each rotatably connected to one of said feed rollers;

a timing belt connecting said drive pulley and said driven pulleys; and clutch means connected between each of said driven pulleys and said one feed roller for selectively transmitting rotation of said driven pulley to said one feed roller.

9. A sheet feeder according to claim 8, wherein said clutch means includes a plurality of clutch mechanisms, each including:

first and second connectors having complementary mating indentations, said first connector being fixed to said respective driven pulley and said second connector being connected to said respective feed roller and axially slidable to engage or disengage said first connector;

means for normally biasing said second connector away from said first connector to disengage said connectors; and means for selectively engaging said connectors to transmit rotation of said output shaft of said drive source to said respective feed roller.

10. A sheet feeder according to claim 9, wherein each of said engaging means includes:

a support frame;

an electromagnet fixed to said support frame;

an armature pivotally mounted on said support frame and having a first end contacting said second connector; and means for biasing said armature out of contact with said electromagnet;

wherein excitation of said electromagnet pivots said armature into contact with said electromagnet and moves said second connector into engagement with said first connector.

* * * * *